United States Patent [19]

Eul

[11] Patent Number: 4,932,462

[45] Date of Patent: Jun. 12, 1990

[54] METHOD AND MACHINE FOR THE CONTINUOUS CASTING OF METAL STRANDS FROM HIGH-MELTING METALS, IN PARTICULAR OF STEEL STRANDS

[75] Inventor: Wilhelm Eul, Oberhausen, Fed. Rep. of Germany

[73] Assignee: Heide Hein Engineering & Design, Moers, Fed. Rep. of Germany

[21] Appl. No.: 244,065

[22] Filed: Aug. 22, 1988

[30] Foreign Application Priority Data

Dec. 22, 1986 [DE] Fed. Rep. of Germany ..... 3643940
Oct. 31, 1987 [DE] Fed. Rep. of Germany ..... 3736956
Dec. 19, 1987 [WO] PCT Int'l Appl. ... PCT/DE87/00603

[51] Int. Cl.[5] ..... B22D 11/00

[52] U.S. Cl. ..... 164/478; 164/454; 164/488; 164/418; 164/437

[58] Field of Search ..... 164/416, 418, 437, 459, 164/472, 474, 473, 478, 488

[56] References Cited

U.S. PATENT DOCUMENTS 3,467,167 9/1969 Mahin ..... 164/475
3,467,168 9/1969 Charman, Jr. ..... 164/478
4,073,333 2/1978 Korshunov et al. ..... 164/475
4,611,651 9/1986 Gourmel et al. ..... 164/474

FOREIGN PATENT DOCUMENTS 58-112636 7/1983 Japan ..... 164/459
967699 8/1964 United Kingdom .
2116888 10/1983 United Kingdom .

*Primary Examiner*—Richard K. Seidel
*Attorney, Agent, or Firm*—Horst Kasper

[57] ABSTRACT

The outflowing casting metal on the path to solidification is no longer subjected to reoxidation and degassing of the casting metal in case of unkilled melts and can immediately be performed ahead of the casting process in a method for continuous casting of metal strands from high-melting metals with cross-sections close to the end dimensions according to the principle of the communicating pipes, and further a temperature and analysis correction can be performed. These conditions are fulfilled by pressing the casting metal from a higher disposed storage container through the communicating channel pipe (8) into a pressure vessel (13) with a gas dome (20), where the casting metal is further transported through an immersion pipe (14), which immerses into the casting metal through the gas dome, into a substantially vertically oscillating independent continuous casting die (15) and where the casting strand formed is deflected in an arc from the vertical direction into the horizontal direction and is withdrawn.

33 Claims, 7 Drawing Sheets

METHOD AND MACHINE FOR THE CONTINUOUS CASTING OF METAL STRANDS FROM HIGH-MELTING METALS, IN PARTICULAR OF STEEL STRANDS

CROSS-REFERENCE TO RELATED APPLICATIONS

This application is a continuation-in-part application of another international application filed under the Patent Cooperation treaty Dec. 17, 1986, bearing Application No. PCT/DE 87/00603, and listing the United States as a designated country. The entire disclosure of this latter application, including the drawings thereof, is hereby incorporated in this application as if fully set forth herein.

BACKGROUND OF THE INVENTION

1. Field of the Invention

The present invention relates to a method and a device for the continuous casting of metal strands of high-melting, metals, in particular of steel strands, with cross-sections close to the end dimensions, according to the principle of the communicating pipes, where the casting metal, in each case, is pressed from a pressure vessel through, in each case, a channel pipe into, in each case, a continuous casting die.

2. Brief Description of the Background of the Invention Including Prior Art

A multitude of continuous casting methods are known for the production of semi-finished materials or, respectively, blanks for roller mills. Some of these methods are also being used in industrial production. Circular curved mold machines or bow-type continuous casting machines, vertical bending continuous casting plants, pressure casting methods, and horizontal continuous casting methods, are some of these methods.

The known methods either entail technical problems or they are very expensive in the set-up technique and furthermore represent a high requirement in personnel and investment costs. Powerful and high throughput plants, in addition, are very inflexible in the kind of products they can produce.

In particular, the requirement of a casting plant corresponding to the preceding considerations for the production of final dimension close cross-sections is inadequately met by the state of the art. A known method for the production of this steel strands with a continuous casting die of very narrow cross-section suffers from substantial casting technique problems, for example, the cleaning of the casting metal bath surface in the die of the slag is made very difficult due to the very narrow cross-section. Moreover, the problem of the casting up at high casting speeds remains unresolved.

A further, also unsatisfactorily resolved, problem is the slag collected in the continuous casting die, which requires not only substantial expenditures for the casting powder, but also imposes substantial requirements on the casting operators. Because of this last requirement, insufficiently trained personnel seems to be the cause of many casting errors and faults.

A further problem of the known continuous casting methods is the reoxidation of the steel melt before and during the casting process. Thus, for example, the pipe between the ladle and the distributor has to be removed for several procedures, whereupon a reoxidation of the flowing casting stream occurs immediately. Substantial time and cost problems arise in the region of the so-called intermediate distributor. The voluminous distributors have to be aligned precisely above the continuous casting die, which becomes more and more of a problem in case of very narrow strands.

All continuous casting methods applied under large-scale industrial conditions are associated with the disadvantages of a large requirement in personnel in the technical casting process at the ladle, the distributor, the dies. In addition to substantial costs, there result also large deficiencies in the performing and guiding of the process and in the quality of the products.

The present invention starts from the state of the art, as described in the "Handbook of Continuous Casting" by Herrmann Verlag, Aluminium, Düsseldorf, Edition 1958, page 691 with picture 1930, and page 694 with picture 1940.

UK Patent Application No. GB 2,116,888 A to Evegny Alexeevich et al. teaches a semicontinuous casting apparatus, where a mold is employed for withdrawing cast metal.

British Patent Specification No. 967,699 to James Nelson Wognum teaches a continuous casting method where molten metal gradually solidifies and emerges continuously below the mold sections in the region 13 as a solidified cast billet strip.

Accordingly, either a sharp transition from the vertical into the horizontal or only a vertical withdrawal of the strand are known in a system of upward rising casting and a communicationg pipe of a stationary vertical or horizontal continuous casting die associated with reoxidation and pouring cup funnel, a fixed position vertical or horizontal continuous casting die.

Accordingly, with a system of the casting poured from bottom and a communicating pipe, there is known a pouring cup to which reoxidation adheres, a fixed-position vertical or horizontal continuous casting die and either a sharp transition from the vertical into the horizontal or only a vertical strand withdrawal.

SUMMARY OF THE INVENTION

1. Purposes of the Invention

It is an object of the present invention to form a pouring ladle insert of such kind that the casting metal flowing off is no longer subjected to a reoxidation on the path to freezing.

It is another object of the invention to perform a degassing of the cast metal immediately before the casting process, even in case of unkilled and unquiet melts.

In particular, it is an object of the invention to furnish the means of performing shortly before the pouring off a temperature and a chemical analysis correction and to achieve the control of the charge of casting metal to the continuous casting die without additional manual or apparatus expenditures.

These and other objects and advantages of the present invention will become evident from the description which follows.

2. Brief Description of the Invention

The present invention provides that the casting metal is pressed from a storage container disposed at a higher level through a communicating channel pipe into a pressure vessel with a gas dome. If a number of vessels of different shapes are interconnected or communicating, it will be found that a liquid poured into them will stand at the same level in each. The pressure depends only on the depth below the liquid surface and not at all on the shape of the containing vessel. If the depth of the liquid is the same in each vessesl, the pressure at the base of each is the same and hence the system is in equilibrum. The casting metal is transported through a vertical immersion pipe into a substantially vertically oscillating independent continuous casing die, which immersion pipe is immersed into the casting metal through the gas dome, and the formed continuous casting strand is deflected in an arc from the vertical to the horizontal and is withdrawn. This method combines the advantage of a complete absence of air from the casting metal up to the exit of the substantially through and through frozen metal strand at the output of the continuous casting die. The metal charge can be easily controlled through pressure control via the gas dome. In case of an upward rising casting from the bottom, a microstructure free of voids is generated. The casting metal can be degassed immediately before the proper casting process without substantial losses in temperature. A fishing for slag material ahead of the die can also be dispensed with. According to the method, in addition semikilled and unkilled steels can be cast.

An improvement results, where the pressure generated in the gas dome is controlled congruently with the continuous casting die oscillation. The freezing situation in the continuous casting die, i.e. the formation of the shell of the strand, can be advantageously influenced with this step.

Additional advantages result where a metallostatic pressure difference of at least 780 torr is continuously maintained between the solidification front in the cast metal strand and the cast metal surface in the pressure vessel or, respectively, of the cast metal surface in the vacuum chamber. These meaures assure the production of a dense microstructure, where degassing processes can be suppresses at this location.

The apparatus for performing the method is based on a pressure vessel and a continuous casting die connected by way of a channel pipe.

Such an item is further improved by the further invention that an exchangeable ladle shell is disposed via the channel pipe ahead of the pressure vessel, that an immersion pipe is immersed into the casting metal disposed in the pressure vessel through gas dome, and that the immersion pipe is attached at an oscillating continuous casting die disposed above the pressure vessel, and that a sealing compensator for the die oscillation motion is disposed between the pressure vessel and the continuous casting die. The ides of a gas dome, in connection with the pressure vessel, allows keeping the casting metal away from sealing parts against the contintuous casting die in connection with a rising and reoxidation-free casting.

Advantageously, the degassing of the casting metal can be provided during the casting process, by inserting a vacuum chamber with air-tight port connection between the ladle shell and the pressure vessel.

According to further features of the invention, it is provided that the channel pipe discharges at the pressure vessel in the region of the pressure vessel floor. Advantageously, thereby the shape and the length of the channel pipe can be influenced or, respectively, determined, or selected.

According to a further embodiment of the invention, it is disclosed that the casting metal level in the vacuum chamber is higher than the upper side of the horizontally withdrawable metal strand. Thereby, the desired pressure relations are set in the casting metal or, respectively, in the solidifying metal strands.

According to a further embodiment of the invention, it is provided that a pouring line is predisposed to the pressure vessel, which pouring line comprises a degassing device and/or a pressure storage and/or an alloy addition device and/or a heating device. These features are sensible for providing advantageous pretreatment steps for the casting metal in order to avoid, for example, undesired separation and segregation processes.

It is furthermore provided that, in each case, a slider is disposed following to the vacuum chamber and disposed ahead of the pressure vessel. These sliders assure a maintenance of the pressure in parts of the plant, in case a pressure drop should occur in other parts of the plant.

A futher group of features comprises that the pressure vessel exhibits a substantially larger cross-section versus the channel pipe or, respectively, versus the immersion pipe. This feature allows the formation of a gas dome. Segregation and degassing processes can proceed easier if desired as well as slag removal processes.

A futher feature comprises that the pressure vessel is provided in its upper region with a slag-tapping device. This allows to remove residual slag without special requirements.

A possibility of exchanging the immersion pipe is advantageously achieved and alleviated by disposing a frame between the compensator and the continuous casting die, where the frame is supported or, respectively, driven by a die oscillation drive and where the die oscillation drive also supports the continuous casting die.

The formation of the casting strand or, respectively, of the metal strand is futhermore favored by providing the continuous casting die formed of cooled copper plates at its charge points with semipermeable strips and that these strips are provided with lubricant channels, which are connected to a high-pressure lubricant pump. Thereby, the friction of the metal strand is reduced and the delamination of the forming strand shell is supported simultaneously.

According to further features, a slider is disposed between the continuous casting die and the immersion pipe. This step allows a changing of the continuous casting die without the changing of the immersion pipe, i.e. upon changing from one form-shape of the metal strand to a new form-shape.

The die oscillation with a concurrently moving immersion pipe requires a new path of construction. It is disclosed in this context that the compensator comprises a labyringth lower part attached to the pressure vessel and a labyrinth upper part attached to the continuous casting die or, respectively to the slider, where the labyrinth lower part and the labyrinth upper part are provided with cooperating intermeshings, where the motion stroke of the labyrinth upper part and the labyrinth lower part corresponds to the stroke of the continuous casting die. In this way, the oscillation of the die can be advantageously balanced and the sealing elements are protected from damage in cases of emergency.

Advantageous features for the sealing elements comprise that the labyrinth lower part and the labyrinth upper part form a cylindrical outwardly disposed seal. Such a seal is easier to control.

The seal can be formed according to a further feature either in the kind of a piston-ring seal, or in the kind of a ring skin fell.

A step for protecting against the operating heat comprises that the seal is cooled. Such a cooling can be performed from the outside or from the inside or from both two sides.

The invention is not limited to applications of a one-vein continuous casting plant. It is therefore disclosed that several parallel running metal strands can be generated, whereby one or two ladle casing shells are provided and that a rail track runs in front of the continuous casting dies cross to the metal strands, where one or several manipulators for the change of continuous-casting dies, compensators, or immersion pipes can be moved on the rail track. Therefore, only on casting section is necessary for all continuous casting dies. This arrangement allows in addition an interruption of the decanting at a desired strand vein without having to interrupt the casting operation on the other strand veins.

Finally, it is advantageous that an emergency casting device is disposed below the pressure vessel or, respectively, below the connected channel pipe.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
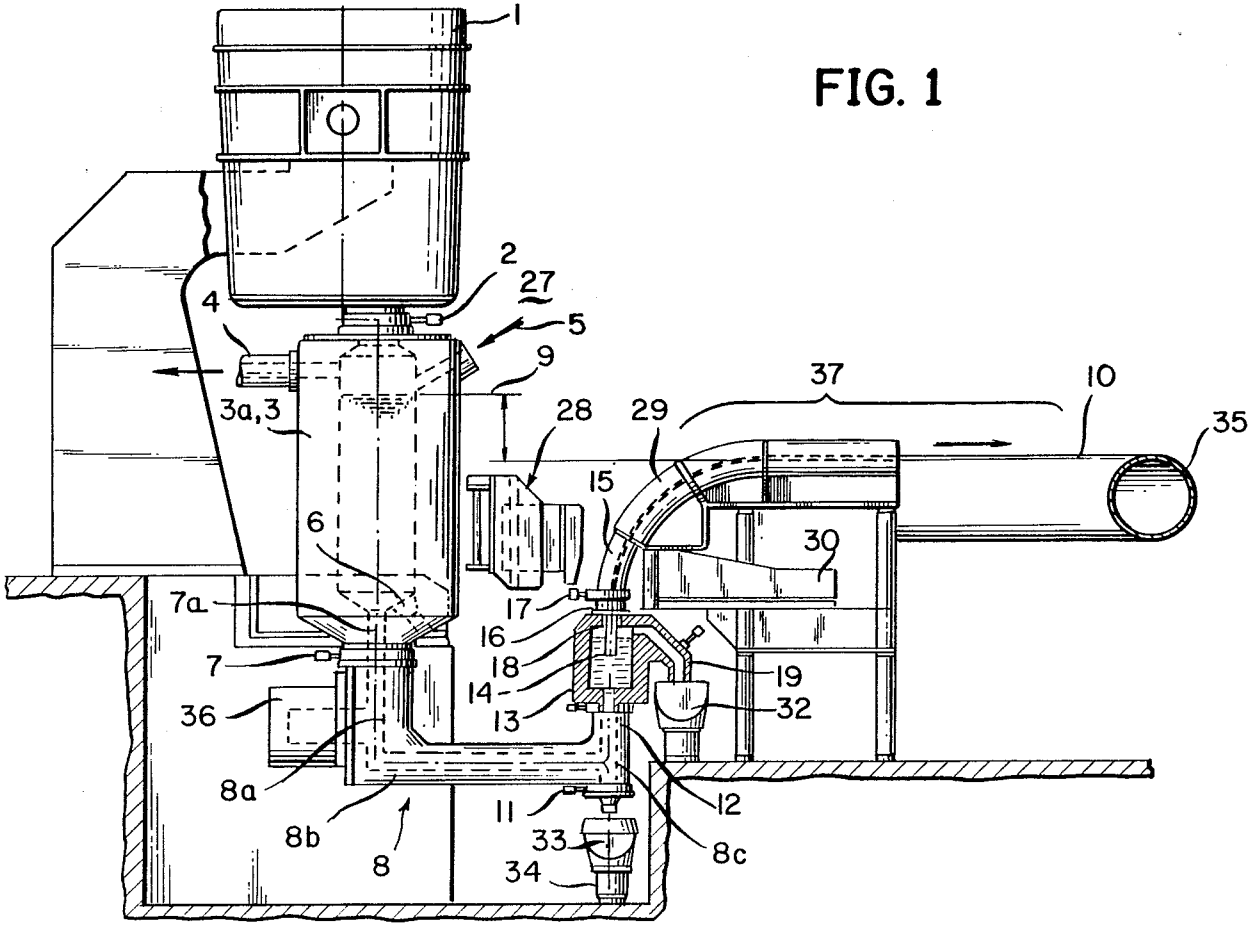
FIG. 1 in an overall elevational sectional view of the continuous casting apparatus, as seen from the side.

In accordance with the present invention, metal strands of high-melting metals, in particular of steel strands are cast, which exhibit cross-sections close to the final dimensions, based on the principle of the communicating pipes. The casting metal, in each case, is pressed out of a pressure vessel 13 through, in each case, a channel pipe 14 into, in each case, a continuous casting die 22. In particular, the casting metal is pressed from a higher disposed storage container 1 through the communicating channel pipe 8 into a pressure vessel 13 with a dome of gas, which transports the casting metal through a vertical immersion pipe 14, which is immersed through the gas dome 20 into a casting metal, into a substantially vertically oscillating independent continuous casting die 22. The cast strand formed is deflected in an arc curve from the vertical direction to a horizontal direction and is withdrawn.

The pressure generated in the gas dome can be controlled in congruence with the continuous casting die oscillation. A metallostatic pressure difference of at least 780 torr can be continuously maintained between the solidification front in the case metal strand and the cast metal surface in the pressure vessel or, respectively, the case metal surface in the vacuum chamber.

According to a further aspect of the invention, a pressure vessel and a continuous casting die are connected by way of a channel pipe. An exchangeable ladle shell 1 is pre-disposed to the pressure vessel 13 via the channel pipe 8. An immersion pipe 14 is immersed through a gas dome 20 into the casting metal disposed in the pressure vessel 13. The immersion pipe 14 is attached at an oscillatable continuous casting die 15. The continuous casting die 15 is disposed above the pressure vessel 13. A sealing compensator 16 for the continuous casting die oscillation motion is disposed between the pressure vessel 13 and the continuous casting die 15.

A vacuum chamber 3 with an air-tight connection sections is preferably disposed between the ladle shell 1 and the pressure vessel 13. The channel pipe 8 advantageously discharges at the pressure vessel 13 in the region of the pressure-vessel floor. The level of the molten metal 9 in the vacuum chamber 3 should be higher than the upper side of the horizontally withdrawable metal strand 10. A pouring section can be pre-disposed to the pressure vessel 13. The casting section can include a degassing device and/or a pressure storage **3*a* and/or an alloy-charging apparatus 5 and/or a heating device 36. In each case sliders 7, 12 are disposed at the vacuum chamber 3 following and ahead of the pressure vessel 13. The pressure vessel 13 is provided with a substantially larger cross-section as compared to the channel pipe 8 or, respectively, as compared to the immersion pipe 14. The pressure vessel 13 is preferably provided with a slag tapping device 19** in its upper region.

A frame 26 is preferably disposed between the compensator 16 and the continuous casting die 15, and frame is supported or, respectively, driven by a die oscillation drive 30, and the die oscillation drive 30 also supports the continuous casting die 15. The continuous casting die 15, formed by the cooled copper plates 22, is provided at the input part **22*a* with semipermeable strips 23. These strips 23 are provided with lubricant channels 24, and the lubricant channels 24 are connected with a high-pressure lubricant pump. A slider 17 can be disposed between the continuous casting die 15 and the immersion pipe 14. The compensator 16 comprises a labyrinth lower part 16*a* attached to the pressure vessel 13 a labyrinth upper part 16*b* attached to the continuous casting die 15 or, respectively, at the slider 17. The labyrinth lower part 16*a* and the labyrinth upper part 16*b* are provided with cooperating intermeshings 16*g*. The motion stroke of the cooperating intermeshing 16*g* corresponds to the stroke of the continuous casting die 15. The labyrinth lower part 16*a* and the labyrinth upper part 16*b* form preferably a cylindrical seal 16*h* disposed on the outside. The seal 16*h* is either of the kind of a piston ring seal 16*d* or of the kind of a ring bellows 16*c*. Preferably, the seal 16*h*** is cooled.

According to FIG. 1, the casting metal, controlled by a ladle slider 2, flows from a ladle shell 1 into a vacuum chamber 3 disposed below the ladle shell 1. The vacuum chamber 3 is connected via a vacuum-generating machine (not illustrated here) with a suction pipe 4.

An alloy-charging device 5 for alloying means and/or scrap is provided at the vacuum chamber 3. A gas-permeable insert 6 is disposed in the floor region of the vacuum chamber 3. A slider 7, disposed in the floor region, forms the closure on the floor side of the vacuum chamber 3 at the start of the casting process and in case where required.

A channel pipe 8 made of refractory material is disposed in connection to a discharge nozzle 7*a* of the vacuum chamber. The channel pipe 8 comprises a vertical, downwardly directed section 8*a*, a horizontal section 8*b*, and a vertical, upwardly directed section 8*c*. The channel pipe 8 is provided at a suitable location with a heating device 36 is order to heat the casting metal if required. The region of the deflection of the section 8*b* into the section 8*c* is furnished with a closure device 11, which closure device 11 allows the possibility required draining of the channel pipe 8. A slider 12 furnishes the connection of the section 8*c*. This slider can serve simultaneously as a floor closure of the pressure vessel 13. It is furthermore possible to provide a second slider. The pressure vessel 13 serves for receiving the liquid casting metal shortly before entering into an immersion pipe 14, which in turn feeds the casting metal to a continuous casting die 15, which continuous casting die 15 can in principle consist of an arc continuous casting die or a straight continuous casting die. Special advantages are associated with each of the two systems.

The immersion pipe 14 can be solidly attached to the casting die. The seal for the pressure vessel 13 can be provided at a height level near the upper end of the immersion pipe. Thereby the immersion pipe 14 forms part of the pressure sealing surface, while the casting die is essentially outside of the pressure area. However, the liquid metal entering the die forms part of the pressure balancing medium for the pressure vessel 13.

The immersion pipe 14 is formed corresponding to the shape to be cast of the metal strand 10 or, respectively, of the corresponding continuous casting die 15. The upper end of the immersion pipe preferably opens up into a mouth having an inner diameter of from about two to four times the inner diameter of the immersion pipe end immersed into the metal melt. The pressure vessel 13 is enlarged in its cross-section versus the channel pipe 8 and is subjected to a gas pressure which builds up in a gas dome 20 and which compensates in part the masses of the continuous casting die 15 and of a die oscillation drive 30. In addition, the enlarged cross-section serves for killing and quieting the flow of the casting metal and in the segregation of materials accompanying the metal, which materials are withdrawn from time to time.

The gas pressure depends on the distance of the level of the molten metal 9 above the upper side of the horizontally withdrawn metal strand 10.

A compensator 16 is disposed above the pressure vessel 13 and a slider 17 is disposed above the compensator 16. The compensator 16 compensates the stroke of the die 15 versus the fixed-position pressure vessel 13 and comprises a labyrinth lower part 16*a* and a labyrinth upper part 16*b*. The labyrinth part is a section of grooves, which are disposed in a engaging relative position on the upper and the lower labyrinth part. Preferably, at least three grooves (valleys) and opposite matching teeth (ridges) are provided. The labyrinth parts are preferably disposed below the upper end of the immersion pipe.

Figure 4:
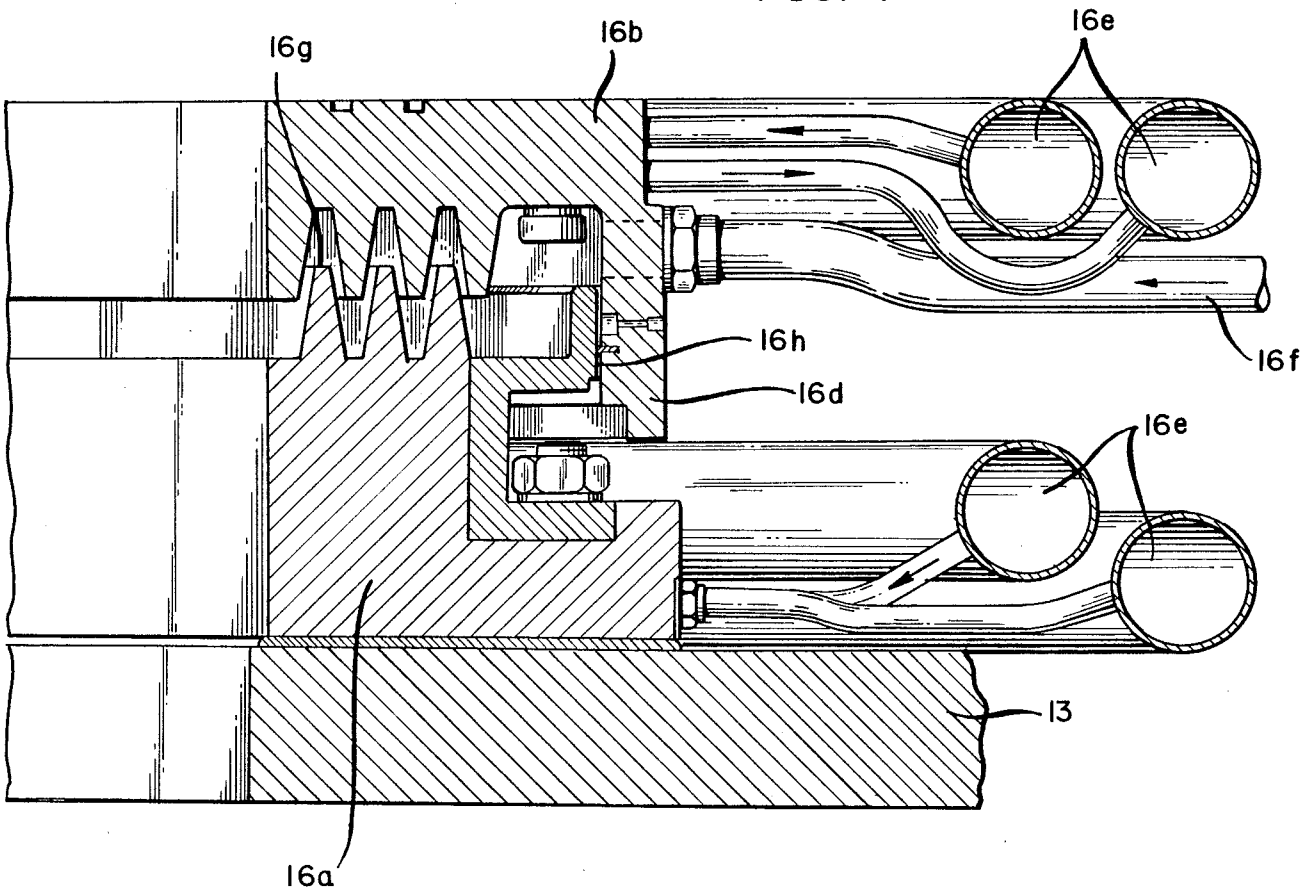
FIG. 4 is a view of a partial cross-section through the compensator according to a first embodiment.

According to FIG. 4, representing a first embodiment, the gas-sealed closure of the lower part 16*a* and the upper part 16*b* is achieved with piston rings 16*d*. The lower part 16*a* and the upper part 16*b* are furnished with cooling means via a conduit system 16*e*. The gas pressure arising in the pressure vessel 13 is controlled and surveyed via a gas line 16*f*. In case of failure or unpermissible drop of the gas pressure in the pressure vessel 13, the labyrinth upper part 16*b* automatically falls onto the labyrinth lower part 16*a* and therefore blocks the flow-through of the casting metal with intermeshing 16*g* and prevents a damaging of the piston rings 16*d*.

Figure 5:
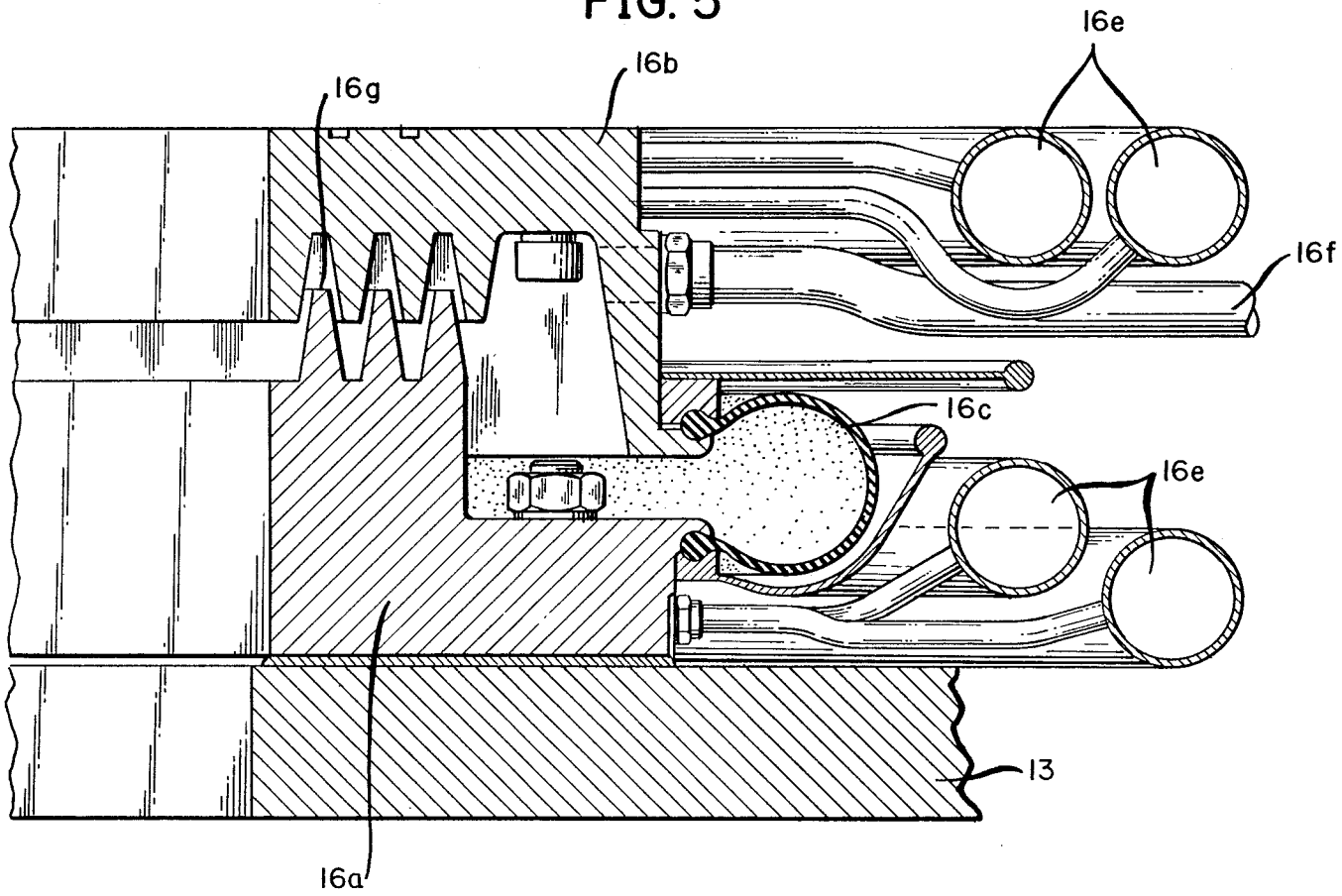
FIG. 5 is a view of a partial cross-section similar to FIG. 4 through the compensator according to a second embodiment.

The labyrinth lower part 16*a* and the labyrinth upper part 16*b* form a cylindrical outwardly disposed seal 16*h* (FIG. 4). This seal 16*h* can be either of the kind of a piston seal 16*d* (FIG. 4), or of the kind of a ring bellows 16*c* (FIG. 5). The piston seal provides that an inner cylinder is matched to an outer cylinder for allowing a sealing and sliding motion in a direction of the cylinder axes or vertical in case of this invention. The overlap area of the cylindrical surfaces can be from about 0.5 times 3 times the depth of the grooves or, respectively, the height of the matching teeth.

The ring bellows resemble in their shape a tubeless automobile tire, and can be represented by a torus which is cut open along the innermost circle of the torus and where the end edges are reinforced to a thicher rim having a diameter of from about three to ten times the thickness of the torus section. The diameter of the body section of the torus can be from about 1.5 to 3 times the depth of the groove.

According to FIG. 5, illustrating a second embodiment, the labyrinth lower part 16*a* and the labyrinth upper part 16*b* are connected with a flexible element, i.e. with a ring packing collar 16*c*, whereby the ring packing collar 16*c* is protected against damage by the intermeshing 16*g*.

The pressure vessel 13 exhibits a gas input 18 and a slag tapping device 19.

The continuous casting die 15 is provided with a second slider, not illustrated, which is disposed above the slider 17 for a modified control technique.

Figure 2:
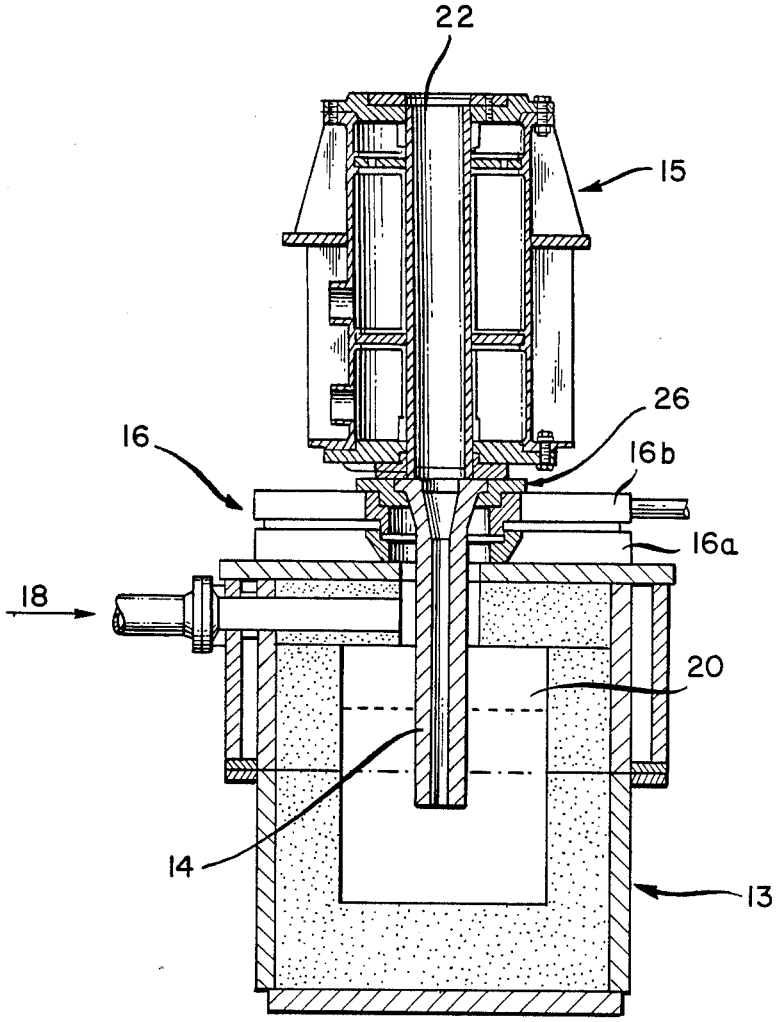
FIG. 2 is a sectional view relative to an arc continuous casting die with immersion pipe and pressure vessel in a vertical section, in an enlarged scale as compared to the scale in FIG. 1.

The continuous casting die 15 id further provided with copper plates 22 (FIG. 2), which provide the shape of the metal strand. The copper plates 22 can be formed as a continuous casting die 15 producing a block, a pipe, or a plate, and the copper plates 22 are cooled from the outside. Preferably, water under pressure is employed to provide cooling.

Figure 3:
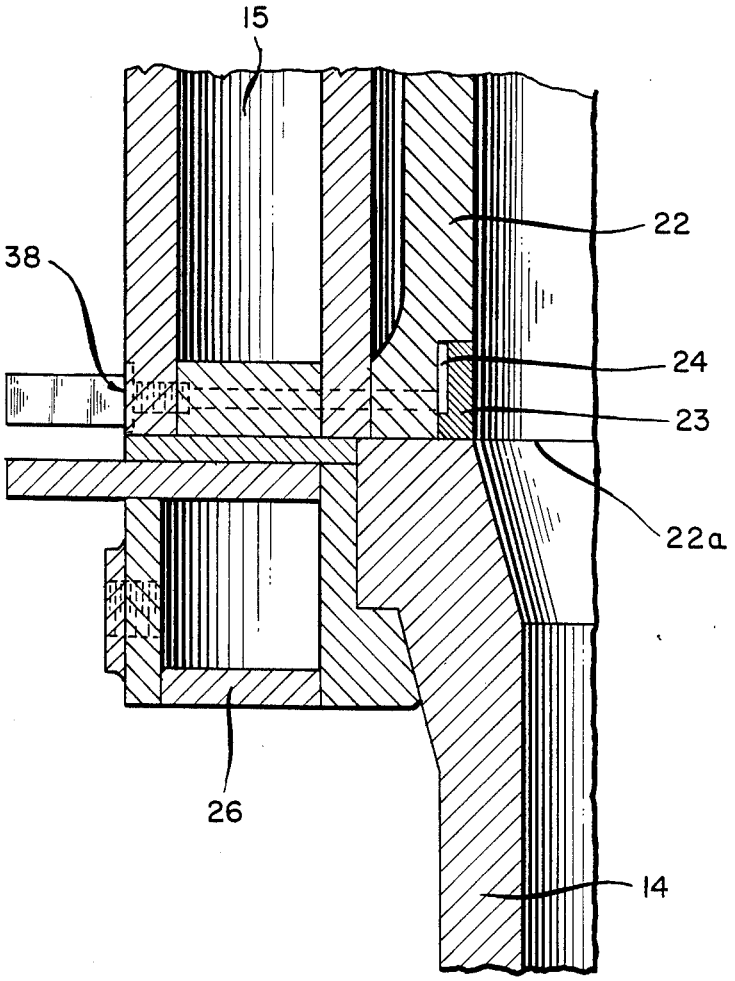
FIG. 3 is a detailed view between the arc continuous casting die and the immersion pipe in the longitudinal view of FIG. 2, however at an even more enlarged scale.

At the input part 22*a* of the continuous casting die 15 (FIG. 3), there are annularly disposed semipermeable strips 23, which serve for the feeding and distribution of suitable lubricants. The strips 23 are provided with channels 24. The channels 24 are formed in sectors and are furnished with lubricant through the line 38 via a multicylindrical injection pump (not illustrated). An internally cooled frame 26 is disposed between the compensator 16 and the continuous casting die 15, which is supported or, respectively, driven by the die oscillation drive 30 and which, in addition, supports the continuous casting die 15.

Several parallel running metal strands 10 can be produced in case where one or two ladle shells 1 are provided. A track path 28*a* runs in front of the continuous casting dies 15 across to the metal stands 10. One or several manipulators 28 can be moved on the track path 28*a* for the change of the continuous casting dies 15, compensators 16, or immersion pipes 14. An emergency casting arrangement 33, 34 can be disposed below the pressure vessel 13 or, respectively, the connected channel pipe 8.

Figure 6:
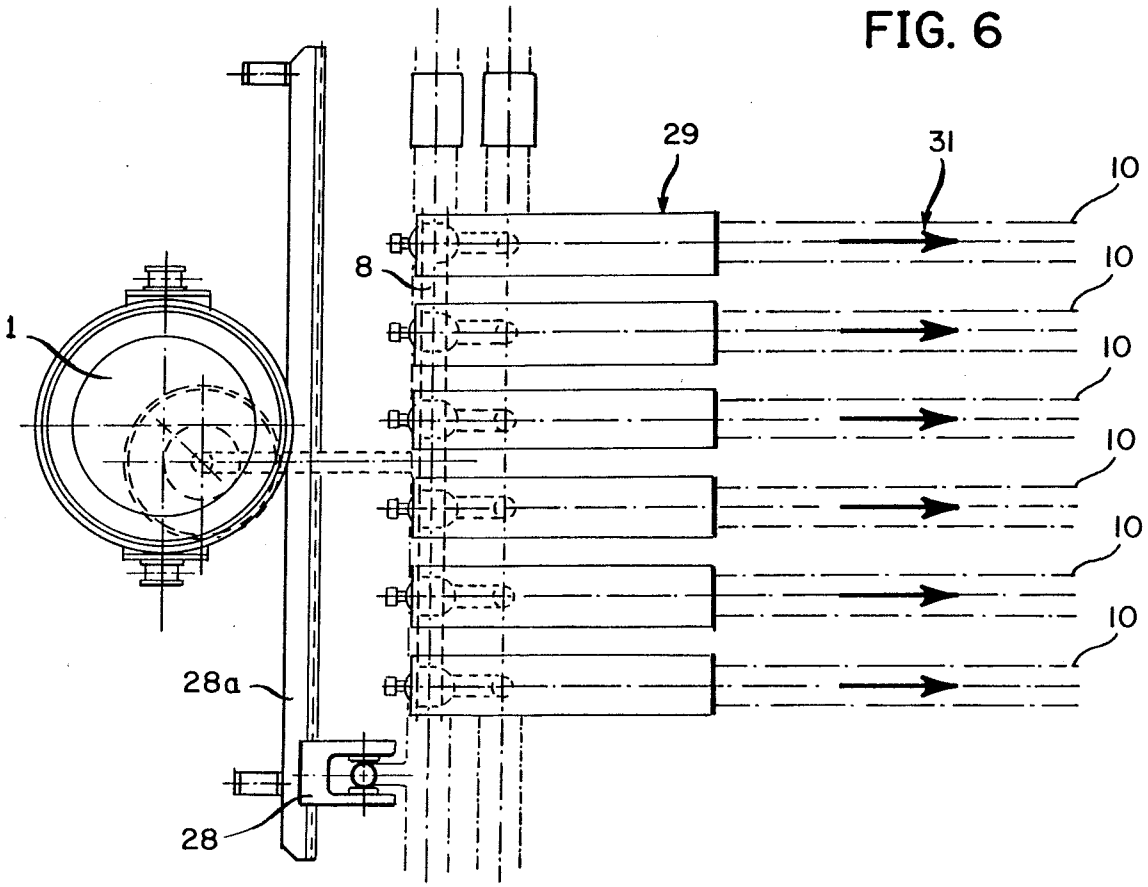
FIG. 6 is a foundation plan for a multi-strand continuous casting plant according to a first embodiment.
Figure 7:
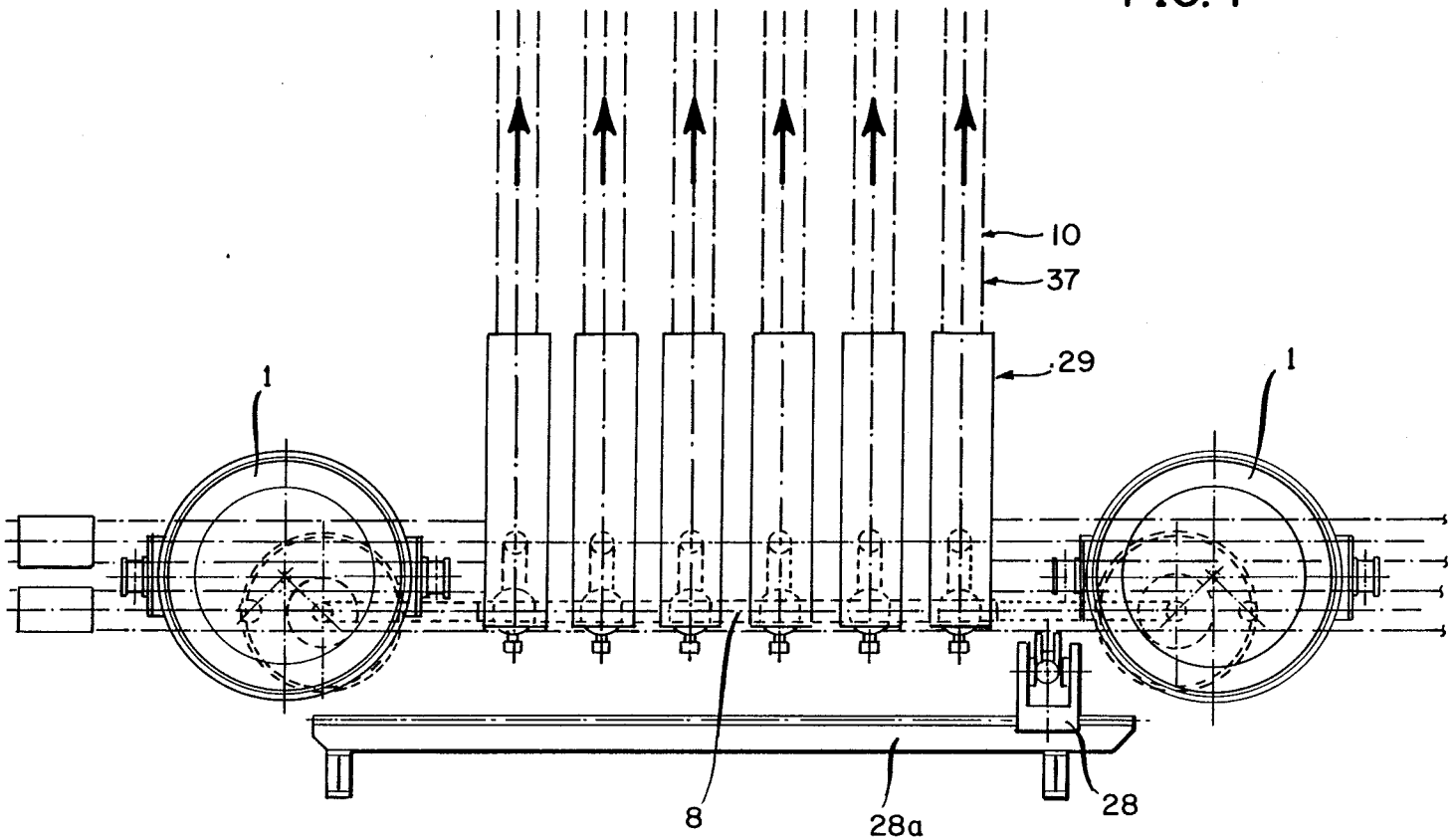
FIG. 7 is a foundation plan, as FIG. 6, for a multi-strand continuous casting plant according to a second embodiment.

According to FIG. 6 or, respectively 7, there can be disposed several systems for metal strands 10 next to one another. In this case, the channel pipe 8 runs in each case in the symmetry axis of the continuous casting dies 15, i.e. perpendicular to the continuous strand withdrawal direction 31. In the case of high-power plants, advantageously, two ladle shells 1 are provided on the left and on right of the plant, respectively. Thereby, a frictionless changing of the ladle shells 1 is made possible without requiring the usual rotary tower for the ladle with unavoidable ladle-change times.

The casting stand front 27 (FIG. 1), disposed remote to the plant part of the strand output 37, in general serves for controlling the plant and for servicing it. For this purpose, a manipulator 28 is provided on rails 28*a* in order to allow the handling of the following and other devices:

the immersion pipe 14
the compensator 16
the slider 17
the continuous casting die 15
segments 29 of the continuous casting guide.

The die oscillation drive 13 as well as segment drives (not illustrated) are disposed below the strand output 37.

A slag-receiving device 32, movable crosswise to the metal strands 10, is provided immediately next to the pressure vessel 13 for the slag resulting from the pressure vessel 13.

For receiving of the casting metal from the casting section in case of emergency and other situations, there is provided a tapping device 33. The tapping device 33 can be moved crosswise with a carriage 34 and is furthermore discharged outside of the casting region by a hoist.

A reeling plant of winding plant 35 is provided for the handling of thin metal strands 10 in the strand discharge 36.

It will be understood that each of the elements described above, or two or more together, may also find a useful application in other types of casting system configurations and molten metal processing procedures differing from the types described above.

While the invention has been illustrated and described as embodied in the context of a method and machine for the continuous casting of metal strands from high-melting metals, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for continuous casting of metal strands of high-melting metals with cross-sections close to the final dimensions comprising the steps of pressing the casting metal from a higher disposed storage container through a communicating channel pipe into a pressure vessel having a dome of gas;

oscillating substantially vertically an independent continuous casting die;

transporting casting metal from the pressure vessel through a vertical immersion pipe, which is immersed through the gas dome into the casting metal, into the substantially vertically oscillating independent continuous casting die; deflecting and withdrawing a cast strand formed from the continuous casting die in an arc curve from the vertical direction to a horizontal direction;

maintaining continuously a metallostatic pressure difference of at least about 780 torr between a solidification front in the cast metal strand and the cast metal surface in the pressure vessel.

2. The method according to claim 1, further comprising controlling the pressure generated in the gas dome depending on the continuous casting die oscillation.

3. The method according to claim 1 further comprising maintaining continuously a metallostatic pressure difference of at least about 780 torr between solidification front in the cast metal strand and the cast metal surface in a vacuum chamber.

4. Apparatus for continuous casting of metal strands of high-melting metals comprising a pressure vessel;

a channel pipe connected to the pressure vessel;

an exchangeable ladle shell connected to the channel pipe and pre-disposed to the pressure vessel via the channel pipe;

a gas dome for containing a gas providing the upper section of the pressure vessel;

an immersion pipe immersed through the gas dome into the casting metal disposed in the pressure vessel;

an oscillatable continuous casting die disposed above the pressure vessel, where the immersion pipe is attached at the oscillatable continuous casting die;

a sealing compensator disposed between the pressure vessel and the continuous casting die for allowing a continuous casting die oscillation motion;

a slider disposed between the continous casting die and the immersion pipe.

5. The apparatus according to claim 4 further comprising air-tight connection sections;

a vacuum chamber connected to said ladle shell with one air-tight connection section and connected to the pressure vessel with one air-tight connection section such that the vacuum chamber is disposed between the ladle shell and the pressure vessel.

6. The apparatus according to claim 4 wherein the channel pipe discharges via a sealing connection at the pressure vessel in the region of the pressure-vessel floor.

7. The apparatus according to claim 5 wherein the level of the molten metal in a vacuum chamber is higher than the upper side of the horizontally withdrawable metal strand.

8. The apparatus according to claim 4 further comprising a pouring section pre-disposed to the pressure vessel including a degassing device, a pressure storage, an alloy-charging apparatus, or a heating device.

9. The apparatus according to claim 5 further comprising sliders disposed at the vacuum chamber following and ahead of the pressure vessel.

10. The apparatus according to claim 4 wherein the pressure vessel is provided with a substantially larger cross-section as compared to the channel pipe.

11. The apparatus according to claims 4 further comprising a slag tapping device disposed in the upper region of the pressure vessel.

12. The apparatus according to claim 4 further comprising a die oscillation drive supporting the continuous casting die;

a frame disposed between the compensator and the continuous casting die which frame is supported or, respectively, driven by a die oscillation drive.

13. The apparatus according to claim 4 further comprising a high pressure lubricant pump, wherein the continuous casting die formed by cooled copper plates is provided at an input part with semipermeable strips and wherein these semipermeable strips are provided with lubricant channels, which lubricant channels are connected to the high-pressure lubricant pump.

14. The apparatus according to claim 4 wherein the compensator comprises a labyrinth lower part attached to the pressure vessel, a labyrinth upper part attached to the continuous casting die;

wherein the labyrinth lower part and the labyrinth upper part are provided with cooperating intermeshings, where the motion stroke of the cooperating intermeshings correspond to the stroke of the continuous casting die.

15. The apparatus according to claim 14 wherein the labyrinth lower part and the labyrinth upper part form a cylindrical seal disposed on the outside.

16. Apparatus according to claim 15 wherein the seal is a piston ring seal.

17. Apparatus according to claim 15 wherein the seal is a ring bellow seal.

18. Apparatus according to claims 15 further comprising cooling means for cooling the seal.

19. The apparatus according to claim 4 further comprising a track path running in front of the continuous casting die across to the metal strand;

a manipulator movable on the track path for a change of the continuous casting die, compensator or immersion pipe;

wherein several casting systems are disposed in parallel for production of several parallel running metal strands;

20. The apparatus according to claim 4 further comprising an emergency casting arrangement disposed below the pressure vessel.

21. The apparatus according to claim 4 further comprising a pouring section pre-disposed to the pressure vessel including a pressure storage.

22. The apparatus according to claim 4 further comprising a pouring section pre-disposed to the pressure vessel including a an alloy-charging apparatus.

23. The apparatus according to claim 4 further comprising a pouring section pre-disposed to the pressure vessel including a heating device.

24. The apparatus according to claim 4 wherein the pressure vessel is provided with a substantially larger cross-section as compared to the immersion pipe.

25. The apparatus according to claim 4 further comprising an emergency casting arrangement disposed below the connected channel pipe.

26. A method for continuous casting of metal strands of high-melting metals, in particular of steel strands, with cross-sections close to the final dimensions, where the casting metal is pressed out of a pressure vessel through a respective channel pipe into a respective continuous casting die, wherein the improvement comprises pressing the casting metal from a higher disposed storage container through the communicating channel pipe into a pressure vessel with a dome of gas;

transporting the casting metal from the pressure vessel through a vertical immersion pipe, which is immersed through the gas dome into the casting metal, into a substantially vertically oscillating independent continuous casting die;

deflecting the cast strand formed in an arc curve from the vertical direction to a horizontal direction and is withdrawn;

wherein a metallostatic pressure difference of at least 780 torr is continuously maintained between the solidification front in the cast metal strand and the cast metal surface in a vacuum chamber.

27. The method according to claim 26 wherein the pressure generated in the gas dome is controlled in congruence with the continuous casting die oscillation.

28. The method according to claim 26 wherein the pressure generated in the gas dome is controlled in congruence with the continuous casting die oscillation; wherein a metallostatic pressure difference of at least 780 torr is continuously maintained between the solidification front in the cast metal strand and the cast metal surface in the pressure vessel.

29. In an apparatus for continuous casting of metal strands of high-melting metals, comprising a pressure vessel and a continuous casting die connected by way of an immersion pipe, the improvement comprising an exchangeable ladle shell (1) is pre-disposed to the pressure vessel (13) via the channel pipe (8), that an immersion pipe (14) is immersed through a gas dome (20) into the casting metal disposed in the pressure vessel (13), and that the immersion pipe (14) is immersed through a gas dome (20) into the casting metal disposed in the pressure vessel (13), and that the immersion pipe (14) is attached at an oscillatable continuous casting die (15), where the continuous casting die (15) is disposed above the pressure vessel (13), and that a sealing compensator

(16) for the continuous casting die oscillation motion is disposed between the pressure vessel (13) and the continuous casting die (15).

30. The apparatus according to claim 29, wherein a vacuum chamber (3) with an air-tight connection section is disposed between the ladle shell (1) and the pressure vessel (13);

wherein the channel pipe (8) discharges at the pressure vessel (13) in the region of the pressure-vessel floor;

wherein the level of the molten metal (9) in the vacuum chamber (3) is higher than the upper side of the horizontally withdrawable metal strand (10);

wherein a pouring section is disposed ahead of the pressure vessel (13), where the casting section includes a degassing device and/or a pressure storage (3a) and/or an alloy-charging apparatus (5) and/or a heating device (36);

wherein in each case sliders (7, 12) are disposed at the vacuum chamber (3) following and ahead of the pressure vessel (13);

wherein the pressure vessel (13) is provided with a substantially larger cross-section as compared to the channel pipe (8);

wherein a frame (26) is disposed between the compensator (16) and the continuous casting die (15), which frame is supported or, respectively, driven by a die oscillation drive (30), and where the die oscillation drive (30) also supports the continuous casting die (15);

wherein a slider (17) is disposed between the continuous casting die (15) and the immersion pipe (14); and wherein the pressure vessel (13) is provided with a slag tapping device (19) in its upper region.

31. The apparatus according to claim 29 wherein the continuous casting die (15), formed by the cooled copper plates (22), is provided at the input part (22a) with semipermeable strips (23) and that these strips (23) are provided with lubricant channels (24), which lubricant channels (24) are connected with a high-pressure lubricant pump;

wherein the compensator (16) comprises a labyrinth lower part (16a) attached to the pressure vessel (13), a labyrinth upper part (16b) attached to the continuous casting die (15) or, respectively, at the slider (17), that the labyrinth lower part (16a) and the labyrinth upper part (16b) are provided with cooperating intermeshings (16g), where the motion stroke of the cooperating intermeshings correspond to the stroke of the continuous casting die (15);

wherein the labyrinth lower part (16a) and the labyrinth upper part (16b) form a cylindrical fluid seal (16h) disposed on the outside;

wherein the seal (16h) is either of the kind of a piston ring seal (16d) or of the kind of a ring bellows (16c); and wherein the seal (16h) is cooled.

32. The apparatus according to claim 29 wherein several parallel running metal strands (10) can be produced, where one or two ladle shells (1) are provided, and where a track path (28a) runs in front of the continuous casting dies (15) across to the metal strands (10), where one or several manipulators (28) for the change of the continuous casting dies (15), compensators (16), or immersion pipes (14) can be moved on the track path (28a); and wherein an emergency casting arrangement (33, 34) is disposed below the pressure vessel (13) or, respectively, the connected channel pipe (8).

33. The apparatus according to claim 29, wherein a vacuum chamber (3) with an air-tight connection sections is disposed between the ladle shell (1) and the pressure vessel (13);

wherein the channel pipe (8) discharges at the pressure vessel (13) in the region of the pressure-vessel floor;

wherein the level of the molten metal (9) in the vacuum chamber (3) is higher than the upper side of the horizontally withdrawable metal strand (10);

wherein a pouring section is disposed ahead of the pressure vessel (13), where the casting section includes a degassing device and/or a pressure storage (3a) and/or an alloy-charging apparatus (5) and/or a heating device (36); wherein in each case sliders (7, 12) are disposed at the vacuum chamber (3) following and ahead of the pressure vessel (13);

wherein the pressure vessel (13) is provided with a substantially larger cross-section as compared to the immersion pipe (14); and wherein the pressure vessel (13) is provided with a slag tapping device (19) in its upper region.

* * * * *